US011136984B2

(12) United States Patent
Tipton et al.

(10) Patent No.: US 11,136,984 B2
(45) Date of Patent: Oct. 5, 2021

(54) PUMP ASSEMBLY, SYSTEM AND METHOD FOR CONTROLLED DELIVERY OF MOLTEN METAL TO MOLDS

(71) Applicant: Pyrotek, Spokane Valley, WA (US)

(72) Inventors: Jon Tipton, Aurora, OH (US); Richard S. Henderson, Solon, OH (US)

(73) Assignee: PYROTEK, INC., Spokane, WA (US)

( * ) Notice: Subject to any disclaimer, the term of this patent is extended or adjusted under 35 U.S.C. 154(b) by 162 days.

(21) Appl. No.: 13/654,277

(22) Filed: Oct. 17, 2012

(65) Prior Publication Data

US 2013/0068412 A1 Mar. 21, 2013

Related U.S. Application Data

(63) Continuation-in-part of application No. PCT/US2012/034048, filed on Apr. 18, 2012.
(Continued)

(51) Int. Cl.

| | |
|---|---|
| ***F04D 7/00*** | (2006.01) |
| ***F04D 7/06*** | (2006.01) |
| ***F04D 29/043*** | (2006.01) |
| ***F04D 3/00*** | (2006.01) |
| ***B22D 17/02*** | (2006.01) |
| ***B22D 23/00*** | (2006.01) |
| ***B22D 39/02*** | (2006.01) |
| ***F04D 29/047*** | (2006.01) |

(52) U.S. Cl.
CPC ..... *F04D 7/00* (2013.01); *B22D 17/02* (2013.01); *B22D 23/00* (2013.01); *B22D 39/02* (2013.01); *F04D 3/005* (2013.01); *F04D 7/065* (2013.01); *F04D 29/0473* (2013.01)

(58) Field of Classification Search
None
See application file for complete search history.

(56) References Cited

U.S. PATENT DOCUMENTS 2,459,892 A * 1/1949 Palmer et al. ..... 164/157
2,528,210 A * 10/1950 Stewart ..... F04D 7/065 164/303

(Continued)

FOREIGN PATENT DOCUMENTS

JP 52103003 A 8/1977
JP 2007203311 A 7/2007

*Primary Examiner* — Kevin E Yoon
*Assistant Examiner* — Jacky Yuen
(74) *Attorney, Agent, or Firm* — Fay Sharpe LLP

(57) ABSTRACT

Disclosed is a centrifugal molten metal pump assembly and associated system for controlled delivery of molten metal to molds. The pump assembly comprises a shaft, an impeller coupled to the shaft, a controller to control a rotational speed of the impeller according to a programmable fill profile while delivering the molten metal to the mold. In some embodiments, the pump assembly further comprises a throttle to manipulate a flow rate or pressure of the molten metal relative to a rotational speed of the impeller. The associated system comprises a melting furnace and one or more holding furnaces, each holding furnace including at least one pump assembly therein. Each holding furnace may be of an open configuration to allow for uninterrupted flow of the molten metal from the melting furnace. The system may provide controlled delivery of the molten metal to the mold at a desired flow rate or pressure.

18 Claims, 9 Drawing Sheets

Related U.S. Application Data

(60) Provisional application No. 61/476,433, filed on Apr. 18, 2011.

(56) References Cited

U.S. PATENT DOCUMENTS

| | | | | | |
|---|---|---|---|---|---|
| 3,371,186 | A | * | 2/1968 | Trabilcy | 392/478 |
| 4,023,918 | A | * | 5/1977 | Stahl | F01D 5/048 277/926 |
| 5,215,141 | A | * | 6/1993 | Kuhn et al. | 164/457 |
| 5,286,163 | A | * | 2/1994 | Amra et al. | 415/121.2 |
| 6,152,691 | A | * | 11/2000 | Thut | 415/197 |
| 7,402,276 | B2 | * | 7/2008 | Cooper | 266/235 |
| 2002/0125620 | A1 | * | 9/2002 | Kinosz et al. | 266/44 |
| 2008/0314548 | A1 | * | 12/2008 | Cooper | 164/136 |

* cited by examiner

PUMP ASSEMBLY, SYSTEM AND METHOD FOR CONTROLLED DELIVERY OF MOLTEN METAL TO MOLDS

RELATED APPLICATIONS

This application is a continuation-in-part of, and claims priority to, PCT Application No. PCT/US2012/034048, filed on Apr. 18, 2012, entitled, "MOLD PUMP ASSEMBLY," which is based on and claims priority to U.S. Provisional Application No. 61/476,433, filed on Apr. 18, 2011, entitled, "MOLD PUMP ASSEMBLY," the contents of which are herein incorporated by reference.

BACKGROUND

1. Field of the Invention

The present invention relates generally to molten metal pump systems, and in particular, to a molten metal pump assembly and associated system for controlled delivery of molten metal to molds.

2. Description of Related Art

Various applications exist where liquid or molten metal needs to be moved. Molten metal pumps are an effective way of accomplishing this task. For instance, centrifugal pumps (sometimes referred to as circulation pumps) have been used to circulate molten metal within a container, and to transfer molten metal from one location to another, among other uses. Centrifugal pumps utilize an impeller (or rotor) to direct the flow of molten metal in such applications. However, when it comes to applications such as casting (i.e., filling molds with molten metal) or molten metal dosing, centrifugal pumps have not been used as a means for filling molds.

Instead, the task of filling a mold in casting or dosing applications has traditionally been left to ladeling, pressurized furnaces, and electromagnetic pumps (EMPs). However, these solutions suffer from drawbacks which make them insufficient for filling molds to required fill metrics. For instance, FIG. 1 illustrates an example pressurized furnace 100 (or casting furnace) for filling an associated mold 102 for casting a part out of molten metal 104. The pressurized furnace 100 includes a pressure-tight furnace 106 to hold the molten metal 104 that is to be transferred to a cavity 108 of the mold 102. The pressurized furnace 100 may further include one or more electrical heating elements 110 at the top of the pressure-tight furnace 106 to maintain the molten metal 104 at a desired temperature. Pressurized furnaces utilize air as a pressurizing force such that upon forcing air into an input tube 112, the change in pressure within the pressure-tight furnace 106 causes the molten metal 104 to flow up a feed tube 114 and into the cavity 108 of the mold 102. However, due to the fact that air is a highly compressible medium, it is inherently difficult to control the head pressure of the molten metal 104 with a pressurized furnace. Additionally, the pressurized furnace 100, upon depletion of the molten metal 104 therein, must be frequently refilled with molten metal 104 to repeatedly deliver molten metal 104 to the associated mold 102. This is impractical and inefficient for mass production applications in casting.

Alternatively, EMPs have been utilized to pump molten metal into molds. However, EMPs are expensive relative to centrifugal pumps or similar equipment capable of accomplishing the same task. Additionally, EMPs, like pressurized furnaces, are also difficult to control with respect to accurate delivery of the molten metal.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Accordingly, disclosed herein is a pump assembly and associated system for controlled delivery of molten metal to molds. Embodiments disclosed herein find particular application in casting molten metal (i.e., filling molds with molten metal) as well as molten metal dosing, and will be described with particular reference thereto. However, it is to be appreciated that the disclosed embodiments may also be utilized in other similar applications.

In some embodiments, a system to deliver molten metal to one or more molds comprises a holding furnace including at least one pump assembly therein to deliver the molten metal to at least one mold associated with the pump assembly. The pump assembly comprises a shaft, an impeller coupled to the shaft, and a controller to control a rotational speed of the impeller according to a programmable fill profile while delivering the molten metal to the at least one mold. Additionally, the holding furnace may be of an open configuration and configured to receive the molten metal from a melting furnace, the open configuration allowing for uninterrupted flow of the molten metal from the melting furnace and to the one or more molds. The pump assembly may further comprise a throttle to manipulate a flow rate or pressure of the molten metal relative to the rotational speed of the impeller.

In some embodiments, a process of filling a mold with molten metal comprises transferring the molten metal to a holding furnace, rotating an impeller within the holding furnace to direct a flow of the molten metal to the mold, delivering the molten metal to the mold, and adjusting a rotational speed of the impeller according to a programmable fill while delivering the molten metal to the mold.

In embodiments disclosed herein, a rotational speed of the impeller may be finely controlled via a programmable control profile which is utilized to adjust the electrical voltage applied to a motor of the pump assembly. Importantly, the disclosed pump assembly's ability to fine-tune the flow of molten metal allows for precise fill profiles to be achieved in scenarios such as filling molds for casting applications, and molten metal dosing applications. This is especially important in the context of filling complex molds with molten metal where complete filling of the molds without casting defects (e.g., chemical defects, voids, mechanical defects, etc.) is often required. Furthermore, the embodiments disclosed herein allow for a system to include an open-furnace architecture where a melting furnace may continuously supply molten metal to holding furnaces without the need to interrupt operations in order to refill the furnaces. Thus, the embodiments disclosed herein provide a revolutionary technique for controlled delivery of molten metal to molds which will transform an industry currently reliant on techniques that are insufficient and impractical for filling molds to precise fill metrics.

Other features and advantages of the present invention will become apparent from the following description of the invention, which refers to the accompanying drawings.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
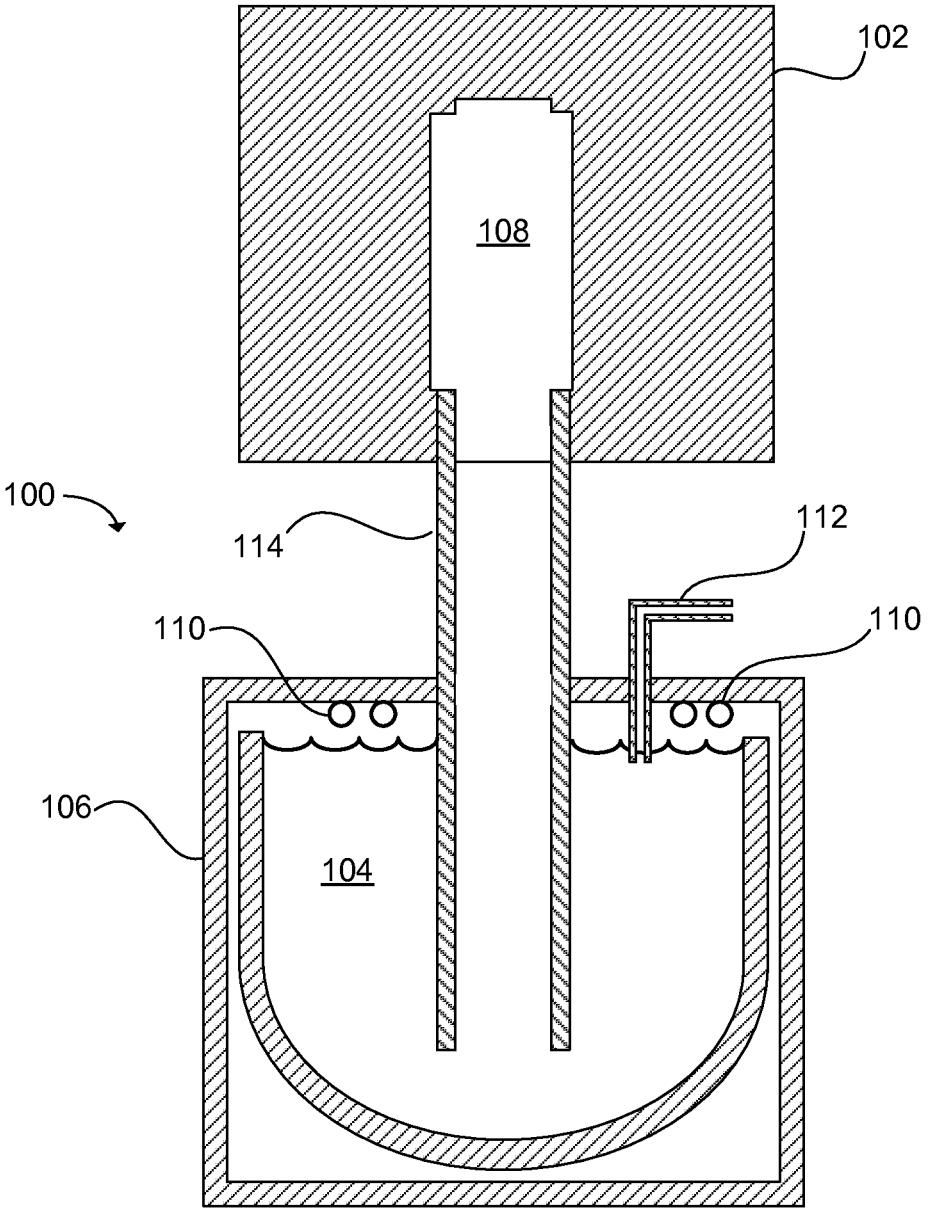
(Prior Art) Fig. 1
FIG. 1 illustrates a cross sectional view of a prior art example of a pressurized furnace used for filling molds with molten metal.
Figure 2:
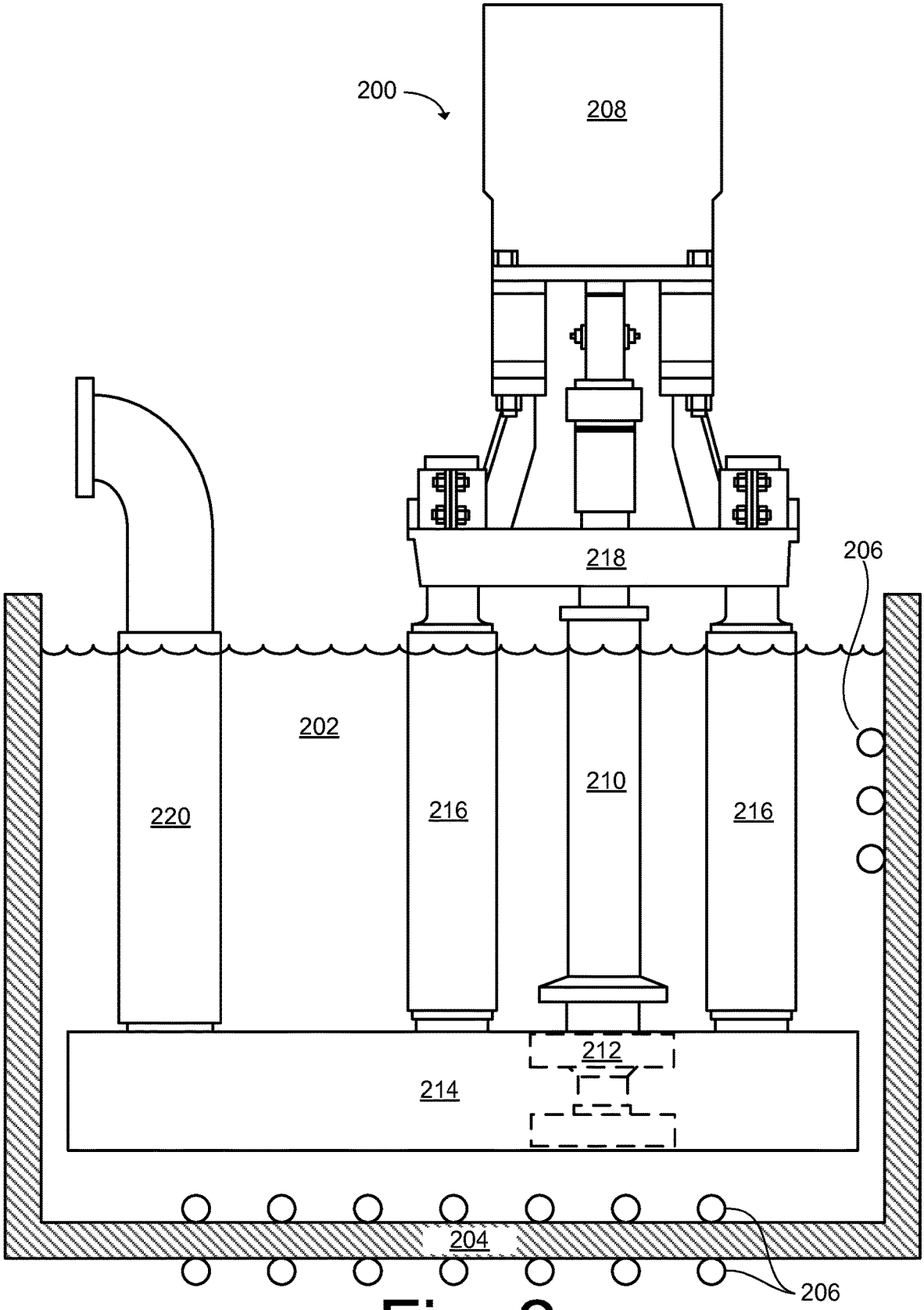
FIG. 2 illustrates a side view of a pump assembly configured to controllably deliver molten metal to a mold, the pump assembly shown from a cross sectional view of a holding furnace for housing the pump assembly therein, the pump assembly including a shaft coupled to an impeller for directing a flow of the molten metal.

Referring to FIG. 2, there is illustrated a centrifugal molten metal pump assembly 200 (hereinafter "pump assembly" 200) according to an example embodiment. As used herein, the terms "centrifugal pump" and "circulation pump" may be used interchangeably to describe the molten metal pump utilized in the pump assembly 200 and described in the embodiments disclosed herein. "Centrifugal pumps" are meant to include any type of variable pressure pump comprising a shaft and impeller assembly.

The pump assembly 200 is shown from a side view submerged in a bath of molten metal 202 which is contained in an open holding furnace 204, or tank (shown from a cross sectional view). As used herein, the term "molten metal" will be understood to mean any metal, such as aluminum, copper, iron, and alloys thereof, which are amendable for casting, dosing or similar applications. The molten metal 202 may be maintained in its molten or liquid state by heating elements 206 disposed in any suitable location around the holding furnace 204. For example, the heating elements 206 may be disposed along the side of the holding furnace 204, or underneath the holding furnace 204 in what is sometimes referred to herein as an "under-heater design" for the open holding furnace 204. In such a configuration, the molten metal 202 is heated from below at an appropriate temperature to maintain the molten metal 202 in liquid form. The heating elements 206 may electrical, gas, oil, or any suitable heating element.

In some embodiments, the pump assembly 200 comprises a motor 208 coupled to a rotatable elongated shaft 210. The motor 208 is configured to be run at variable speeds with a programmable controller (not shown). The programmable controller may be suitably programmed or otherwise configured to execute computer-executable instructions according to a programmable control profile stored in computer-readable memory which causes a rotational speed of an impeller 212 to vary according to the control profile, as will be explained in more detail below with reference to FIGS. 6 and 7.

Additionally, or alternatively, the controller may be part of a feedback control system, or closed-loop control system to monitor the fill status of a mold via sensors which may be situated in the mold and configured to monitor the fill status of the mold. These sensors, may be probes, or any similar monitoring mechanism capable of monitoring a property associated with filling the mold and sending feedback signals to the controller. In this scenario, a desired system output for filling a mold may be specified and may vary over time according to the programmable fill profile. At a particular point in one or more sensors within the mold can measure the actual system output and feed this measured system output to the controller. In some embodiments, the controller is a proportional-integral-derivative (PID) controller, suitable for feedback control systems. The controller takes the error (i.e., difference) between the desired system output and the measured system output and adjusts the command voltage to the motor 208 in order to operate the impeller at a desired rotational speed for maintaining the desired system output.

Accordingly, a computing device may be associated with the pump assembly 200 and equipped with one or more processors, such as the programmable controller, and one or more forms of computer-readable memory. In some embodiments, the computing device may include a computer program product including a non-transitory machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, compact disc read-only memories (CD-ROMs), digital video discs (DVDs), read-only memories (ROMs), random access memories (RAMs), erasable programmable read-only memories (EPROMs), electrically erasable programmable read-only memories (EEPROMs), flash memory, magnetic or optical cards, solid-state memory devices, or other types of media/machine-readable medium suitable for storing electronic instructions.

The computer-readable memory may be used to store any number of functional, or executable, components, such as programs and program modules that are executable on the processor(s) to be run as software. Each component stored in the computer-readable memory may comprise computer-executable instructions that, when executed, cause the one or more processors to perform acts and to implement techniques described herein. Each component may be in the form of data structures, program modules, or other data. The components included in the computer-readable memory may include the aforementioned programmable control profile.

With continuing reference to FIG. 2, the elongated shaft 210 is coupled to the impeller 212, which is located in a chamber, or housing, of a base member 214. The base member 214 is suspended by a plurality of refractory support posts 216 securely coupled to a platform 218, and is submerged in the bath of molten metal 202. Alternatively, a central support tube may be employed to suspend the base member 214, or an alternative form of support post may be employed wherein an elongated metal (e.g., steel) rod surrounded by a protective refractory sheath extends between the platform 218 and the base member 214. In some embodiments, the impeller 212 may be supported within the chamber of the base member 214 by bearing rings which act as a wear resistant surface and allow smooth rotation therein. Additionally, a radial bearing surface may be provided on the elongated shaft 210 or the impeller 212 to prevent excessive "wobble" of the pump assembly 200 which could lead to inefficiency or even failure of pump components.

In some embodiments, the elongated shaft 210 comprises a cylindrically shaped, elongated orientation having a rotational axis that is generally perpendicular to the base member 214. The elongated shaft 210 also comprises a proximal end that is configured to couple to the motor 208, and a distal end that is configured to couple to the impeller 212. The elongated shaft 210 is configured to be rotated by the motor 208 and extends from the motor 208 and into the chamber of the base member 214 such that the impeller 212 is rotated by the elongated shaft 210 and within the chamber of the base member 214. Rotation of the impeller 212 therein causes a directed flow of the molten metal 202 by drawing the molten metal 202 into the chamber via an inlet of the base member 214, and forcing the molten metal 202 out of the chamber via an outlet of the base member 214. The outlet of the base member 214 may be disposed in any suitable location on the base member 214, and is typically adjacent a side wall or top wall of the base member 214. The outlet of the base member 214 may be coupled to a riser 220 for transfer of the molten metal 202 to an associated transfer system, and subsequently to a mold. The associated transfer system typically comprises a system of pipes adapted for fluid communication that also maintain the molten metal 202 at a desired temperature while it is transferred through the transfer system. The riser 220 may be surrounded by a refractory sheath or otherwise suited for submergence in the bath of molten metal 202.

It is to be appreciated that the specific dimensions, proportions, shapes and configurations of each of the component parts of the pump assembly 200 are not specific to the present invention. For example, impeller 212 may be shaped or contoured in various ways to provide a suitable impeller for moving the molten metal 202, and the base member 214 may be of various sizes, or heights, for a particular configuration.

As will be described in more detail below, in some embodiments, a throttle for manipulating a flow rate or pressure of the molten metal 202 is associated with the pump assembly 200. The throttle may be a static throttle or a dynamic throttle. A static throttle, as used herein, means a throttle that does not change in characteristic while the pump assembly 200 is operating. In other words, a static throttle may be thought of as a fixed tolerance throttle. A dynamic throttle, by contrast may be dynamically changed with regard to characteristics such as size, shape or output of the throttle to dynamically adjust the flow rate or pressure of the molten metal 202 via control of the throttle. The throttle, whether static or dynamic, operates to lessen a magnitude of a change in flow rate or pressure of the molten metal 202 relative to a rotational speed of the impeller 212.

In some embodiments, the throttle may be fixed tolerance leakage path (e.g., a "bypass," or "bypass gap"). This leakage path may be finely tuned to a designed tolerance and is operative to enable control of a flow rate and/or a pressure of the molten metal 202 by allowing the molten metal 202 to leak from the chamber 402 to an environment outside of the base member 214 (i.e., an exterior atmosphere) at a predetermined rate. In this scenario, the leakage path is a static throttle.

In yet other embodiments, the throttle may be a dynamic throttle. For example, the tolerance of a leakage path may be dynamically adjusted, via a controllable bearing assembly or similar mechanism that can increase or decrease the amount of molten metal that is leaked to an exterior atmosphere. In yet other embodiments, the throttle may be adjustable/controllable heating elements to tune the heat directed to the holding furnace containing the molten metal 202. This is due to the fact that controllability of the flow rate or pressure may be dependent, at least in part, on a viscosity of the molten metal 202 such that optimal control of the delivery of the molten metal 202 may be manipulated by adjusting the temperature of the molten metal 202 to indirectly change the viscosity of the molten metal. This is an example of a dynamic throttle.

By utilizing a throttle to manipulate the flow rate or pressure of the molten metal 202 relative to the rotational speed of the impeller 212, an associated user is able to finely tune the volumetric amount and/or pressure of the molten metal 202 provided to an associated mold. Accordingly, a throttle further improves the controllability of the delivery of the molten metal 202. It is to be appreciated that controllability may be dependent, at least in part, on a viscosity coefficient of the molten metal 202. Namely, in one embodiment, as the viscosity of the molten metal 202 decreases, a parameter of the throttle (e.g., the size of the impeller 212, or size of the leakage path, temperature of the molten metal, etc.) would need to be adjusted to get the optimal control for the delivery of the molten metal 202. Furthermore, different applications (e.g., dosing, casting, etc.) may call for different sensitivity in response due to a change in the rotational speed of the impeller 212.

Figure 3:
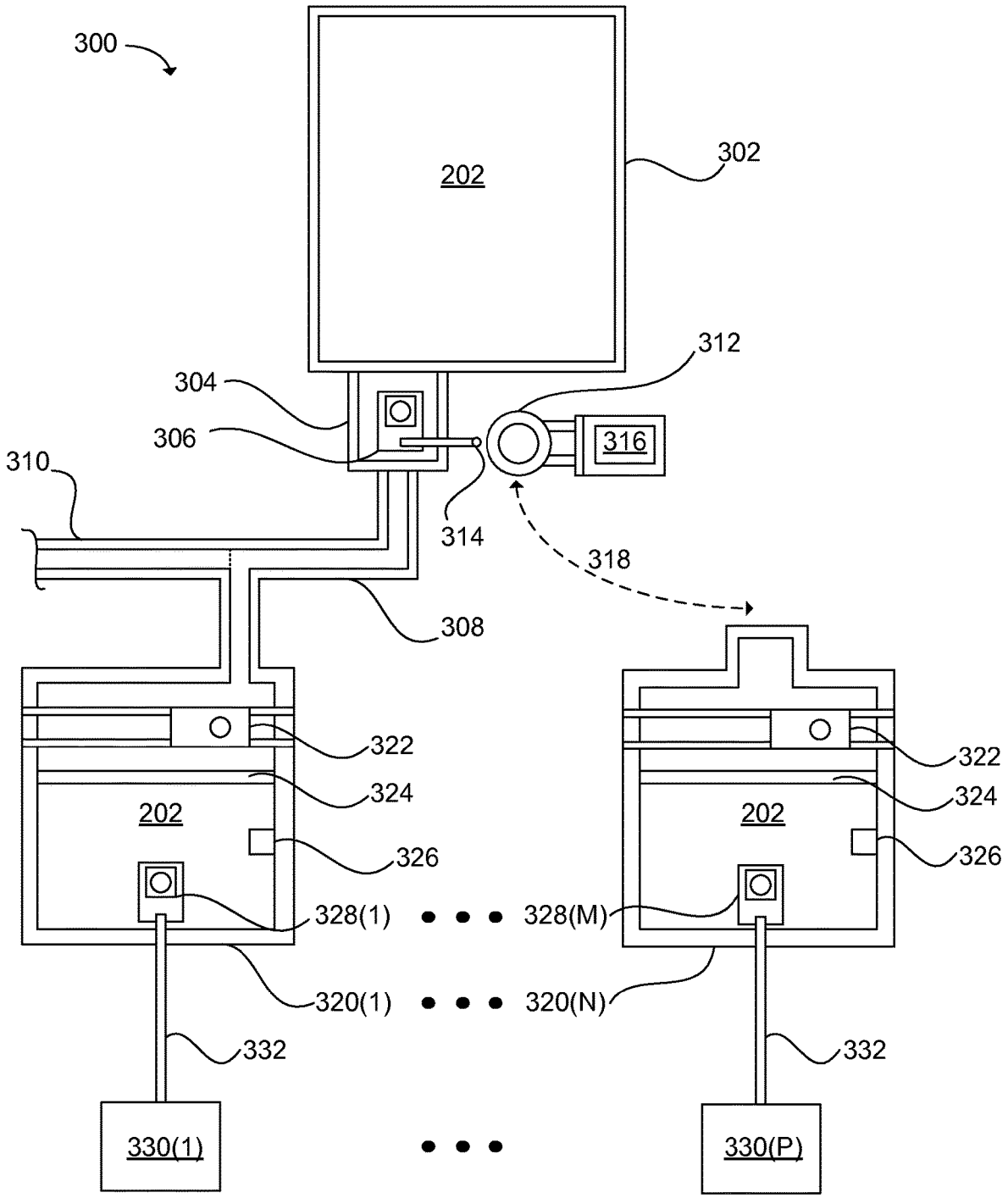
FIG. 3 illustrates a system including one or more pump assemblies for controlled delivery of molten metal to one or more molds.

Referring now to FIG. 3, a system 300 including one or more pump assemblies, such as the pump assembly 200 of FIG. 2, for controlled delivery of molten metal to one or more molds according to an example embodiment is illustrated. The system 300 may represent a plant layout for casting or dosing applications where any number of the pump assemblies 200 described with reference to FIG. 2 may be implemented to deliver molten metal to molds for mass production applications. The system comprises a melting furnace 302, or hearth, which comprises a large bath of molten metal, such as the molten metal 202. The molten metal 202 within the melting furnace 302 is heated, for example, with gas or oil burners, or by any other means known to a person having ordinary skill in the art. Scrap metal may be charged, or otherwise submerged, within the melting furnace 302 where it is melted and maintained at a temperature appropriate for keeping the molten metal 202 in a molten state. In some embodiments, the melting furnace 302 is in fluid communication with a pump well 304, such as via an archway, or similar opening/structure in a wall of the melting furnace 302, allowing for communication of the molten metal 202 from the melting furnace 302 to the pump well 304. In some embodiments, the molten metal 202 may be re-circulated within the melting furnace 302 with a standard circulation pump, or any similar pump known to a person having ordinary skill in the art, and may further include a dross well (not shown), where impurities in the form of dross are skimmed from the surface before molten metal flows into the pump well 304.

The pump well 304 includes a transfer pump 306 configured to pump the molten metal 202 into a launder transfer system 308, which may optionally be heated to maintain the molten metal 202 at an appropriate temperature while it is being transferred via the launder transfer system 308. In some embodiments, the transfer pump 306 may be replaced with an overflow transfer (OFT) system that includes a metal level sensor, such as a laser leveling sensor, which accomplishes the same task of transferring the molten metal 202 from the pump well 304 via the launder transfer system 308. The launder transfer system 308 may comprise a system of troughs, conduits, channels, pipes, etc., adapted for fluid communication. Furthermore, as shown in FIG. 3, the launder transfer system 308 may direct some or all of the molten metal 202 to casting cells, or similar systems, via an optional route 310. In one embodiment, the launder system 308 may be replaced, or augmented, with a transfer ladle 312 which is configured to receive the molten metal 202 via a delivery mechanism 314 from the pump well 304. The transfer ladle 312 may be transported via a lift truck 316 to deliver the molten metal 202 to a holding furnace as shown by the dashed arrow 318 where the molten metal 202 is poured from the ladle 312 when positioned adjacent the holding furnace.

The molten metal 202 is transferred via the launder system 308, or in some embodiments, via the transfer ladle 312, to one or more holding furnaces 320(1)-(N). The one or more holding furnaces 320(1)-(N) are of an open configuration such that each holding furnace 320(1)-(N) is accessible from the top. Accordingly, continuous, or uninterrupted, flow of the molten metal 202 may be provided to the open-holding furnace architecture from the melting furnace 302 such that the requirement to delay or altogether halt operations in the plant for refilling the molds is eliminated. That is, uninterrupted supply of molten metal to the one or more holding furnaces 320(1)-(N) is enabled by virtue of the pump assembly 200 and the open-holding furnace configuration. Each holding furnace 320(1)-(N) is further configured with an under-metal heater design such that the molten metal 202 is heated from below at an appropriate temperature to maintain the molten metal 202 in liquid form. Additionally, or alternatively, heating elements, such as the heating elements 206, may be disposed on one or more sides of the holding furnaces 320(1)-(N). The heating elements may be electrical, gas, oil, or any suitable heating element. In some embodiments, the heating elements are tubular heaters of the "Tonnetsu style," known to a person having ordinary skill in the art. The holding furnaces 320(1)-(N) may optionally comprise lids on the top that at least partially cover the tops of the holding furnaces 320(1)-(N).

Upon entering the holding furnaces 320(1)-(N), the molten metal 202 may optionally be degassed via a degasser 322. The degasser 322 is configured to disperse gas, such as nitrogen, argon, or similar substances, throughout the molten metal 202 in order to precipitate undesirable constituents, such as hydrogen gas. The holding furnaces 320(1)-(N) may further include a filter 324 to filter undesirable constituents that are either precipitated via the degasser 322, or that exist in the molten metal 202 from the scrap that is melted in the melting furnace 302. The holding furnaces 320(1)-(N) may further include a metal level sensor 326, such as a laser level sensor, to ensure that the molten metal 202 within the holding furnaces 320(1)-(N) stays at an optimal level within the holding furnaces 320(1)-(N).

One or more centrifugal molten metal pump assemblies 328(1)-(M) are provided within the holding furnaces 320(1)-(N). The pump assemblies 328(1)-(M) may be the same or similar pump assemblies as the pump assembly 200 of FIG. 2. As described above with reference to FIG. 2, the pump assemblies 328(1)-(M) are configured to controllably deliver the molten metal 202 to one or more molds 330(1)-(P). It is to be appreciated that, in the embodiments disclosed herein, the molten metal 202 may be directly, or indirectly delivered to the mold, and/or the delivery may be with or without being under pressure. In one illustrative example where a mold is being filled under pressure to cast an object such as an engine block, the molten metal 202 may be directly delivered to the mold under pressure. In another illustrative example, the molten metal 202 may be indirectly delivered to the mold via a tundish and/or shot sleeve while the molten metal 202 is not under pressure, such as in dosing applications. It is to be appreciated that the molds 330(1)-(P) may be positioned in various configurations relative to the holding furnaces 320(1)-(N), and in some embodiments, the molds 330(1)-(P) may be positioned above the holding furnaces 320(1)-(N) on platforms or similar structures. Alternatively, as is shown in the diagram of FIG. 3, the molds 330(1)-(P) may be positioned adjacent the holding furnaces 320(1)-(N) and in fluid communication with the holding furnaces 320(1)-(N) via a transfer system 332, which may comprise a series of pipes. The transfer system 332 may be heated by heating elements to maintain the molten metal 202 at a desired temperature while filling an associated mold 330(1)-(P).

It is to be appreciated that the illustrated number of components in the system 300, as well as the illustrated configurations of each of the component parts of the system 300 are not specific to the present invention. For example, any number of holding furnaces 320(1)-(N), pump assemblies 328(1)-(M), or molds 330(1)-(P) may be utilized in the system in any combination or configuration of elements as is deemed suitable for a particular application.

Figure 4A:
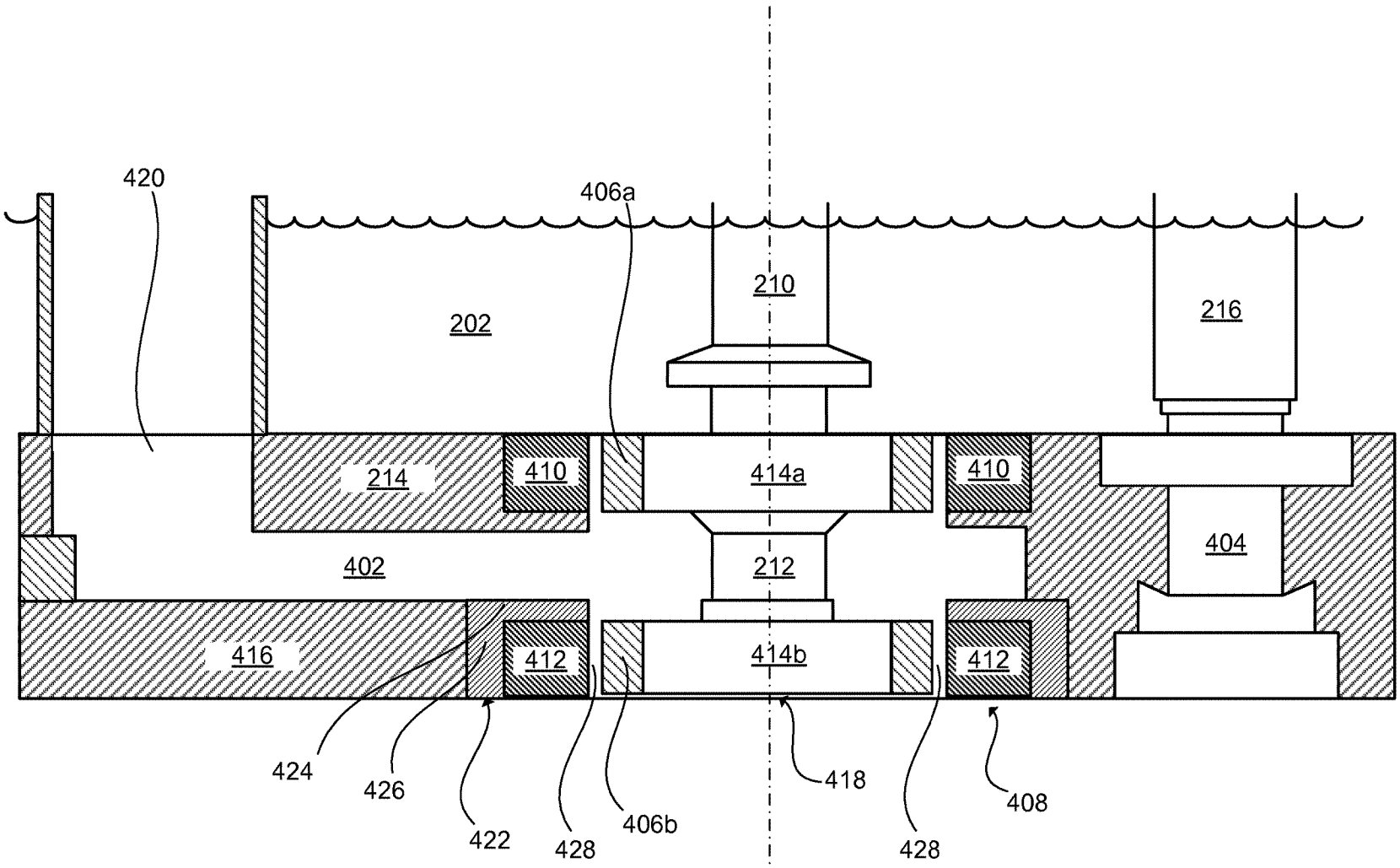
FIG. 4A illustrates a cross sectional view of the base member of an embodiment of the pump assembly of FIG. 2, the base member providing a chamber for housing the impeller, and the pump assembly comprising a leakage path.

Referring now to FIG. 4A, a portion of an embodiment of a pump assembly is shown in further detail. In particular, base member 214 according to an example embodiment of the pump assembly 200 of FIG. 2 is shown from a cross sectional view. As illustrated, the base member 214 defines a chamber 402 configured to receive the impeller 212 such that the impeller 212 may rotate within the chamber 402. The base member 214 is further configured to structurally receive the refractory support posts 216 through passages 404 such that the base member 214 may be suspended in the bath of the molten metal 202. Each passage 404 is configured to receive at least a portion of a support post 216 to securely couple the base member 214 to the platform 218 of FIG. 2.

In some embodiments, the impeller 212 comprises a first radial edge 406*a* that is axially spaced from a second radial edge 406*b* such that the first radial edge 406*a* is adjacent the elongated shaft 210. The first and second radial edges 406*a/b* are located peripherally about a circumference of the impeller 212. In some embodiments, the chamber 402 houses a bearing assembly 408 which comprises a first bearing ring 410 that is axially spaced from a second bearing ring 412. The first radial edge 406*a* is facially aligned with the first bearing ring 410, and the second radial edge 406*b* is facially aligned with the second bearing ring 412 such that the bearing assembly 408 surrounds the impeller 212 within the chamber 402. The first and second bearing rings 410, 412 are made of a material, such as silicon carbide, having frictional bearing properties at high temperatures to prevent cyclic failure due to high frictional forces. The first and second bearing rings 410, 412 are further adapted to support the rotation of the impeller 212 within the chamber 402 of the base member 214 such that the pump assembly 200 of FIG. 2 is prevented from wobbling. The first and second radial edges 406*a/b* of the impeller 212 may similarly be made of material such as silicon carbide. For example, the first and second radial edges 406*a/b* of the impeller 212 may comprise a silicon carbide bearing ring.

In some embodiments, the impeller 212 comprises a first peripheral circumference 414*a* which is axially spaced from a second peripheral circumference 414*b*. The elongated shaft 210 is coupled to the impeller 212 at the first peripheral circumference 414*a*. The second peripheral circumference 414*b* is spaced opposite from the first peripheral circumference 414*a* and is aligned with a bottom portion 416 of the base member 214. The first radial edge 406*a* is adjacent the first peripheral circumference 414*a*, and the second radial edge 406*b* is adjacent the second peripheral circumference 414*b*.

In some embodiments, a bottom inlet 418 is provided in the second peripheral circumference 414*b*. More specifically, the bottom inlet 418 comprises the annulus of a bird cage style of impeller 212. It is to be appreciated that the bottom inlet 418 may be formed of vanes, bores, annulus ("bird cage"), or other assemblies known to a person having ordinary skill in the art. The rotation of the impeller 212 draws the molten metal 202 into the bottom inlet 418 and into the chamber 402 such that continued rotation of the impeller 212 causes the molten metal 202 to be forced out of the chamber 402 at an outlet 420 of the base member 214.

In some embodiments, the bearing assembly 408 comprises a base ring bearing adapter 422 that is configured to couple the second bearing ring 412 to the bottom portion 416 of the base member 214. The base ring bearing adapter 422 comprises a radial flange portion 424 that is securely coupled to a disk body 426 and is operative to support bearing rings of various sizes along the bottom portion 416 of the base member 214. The radial flange portion 424 is adjacent the chamber 402 and is generally perpendicular to the disk body 426. The base ring bearing adapter 422 is generally circular and is configured to receive the second bearing ring 412.

As illustrated in FIG. 4A, a close tolerance may be maintained between the first radial edge 406*a* at the first peripheral circumference 414*a* of the impeller 212 and the first bearing ring 410 of the bearing assembly 408. A throttle in the form of a bypass gap 428 may be provided between at least a portion of the bearing assembly 408 and the impeller 212, such as between the first radial edge 406*a* and the first bearing ring 410. The bypass gap 428 may also be interposed between at least a portion of the second bearing ring 412 and the second radial edge 406*b* at the second peripheral circumference 414*b* of the impeller 212. Accordingly, the bypass gap 428 may comprise a radial space of a designed tolerance that may be varied to allow for a predetermined leakage rate of the molten metal 202. In this embodiment, as the impeller 212 is rotated, the molten metal 202 leaks from the chamber 402 through the bypass gap 428 to an exterior atmosphere at a predetermined rate such that precise control of the flow rate and/or pressure of the molten metal 202 is achieved.

One example technique for varying the tolerance of the bypass gap 428 is to provide bearing rings, such as the first or second bearing rings 410, 412, or base ring bearing adapters 422 of different sizes at the base member 214 which results in a bypass gap 428 of varying sizes. It is to be appreciated that a bored or annulus ("bird cage") bottom inlet 418 may be advantageous in the embodiment utilizing the bypass gap 428 as the design for the leakage path because the types of impellers 212 with such bottom inlets 418 include a defined radial edge, such as the first and second radial edges 406*a/b*, allowing a designed tolerance for the bypass gap 428 to be created within the chamber 402.

In some embodiments, the bypass gap 428 is defined by the second bearing ring 412 such that the second bearing ring 412 has a larger diameter than the first bearing ring 410 in the bearing assembly 408. In another embodiment, the bypass gap 428 is defined by the impeller 212 such that the second radial edge 406*b* of the impeller 212 has a smaller diameter than the first radial edge 406*a* of the impeller 212. Here, the first radial edge 406*a* is abuttingly positioned in contact with, and rotatably supported at, the first bearing ring 410.

In yet other embodiments, the bypass gap 428 may be defined by a plurality of removable, segmented teeth or posts that are radially positioned about the perimeter of the impeller 212 such that the plurality of teeth maintain contact with the bearing ring 412 during rotation of the impeller 212 while radial spaces interposed between the plurality of teeth are configured to allow leakage of the molten metal 202 at a predetermined rate.

In some embodiments, a leakage path may be provided by a plurality of apertures located through the first peripheral circumference 414*a* of the impeller 212 to allow fluid communication with the chamber 402 and an environment outside the base member 214. In this scenario, the first radial edge 406*a* may be surrounded by the first bearing ring 410 such that the first radial edge 406*a* is abuttingly positioned with the first bearing ring 410 and rotates while maintaining contact with the first bearing ring 410.

Figure 4B:
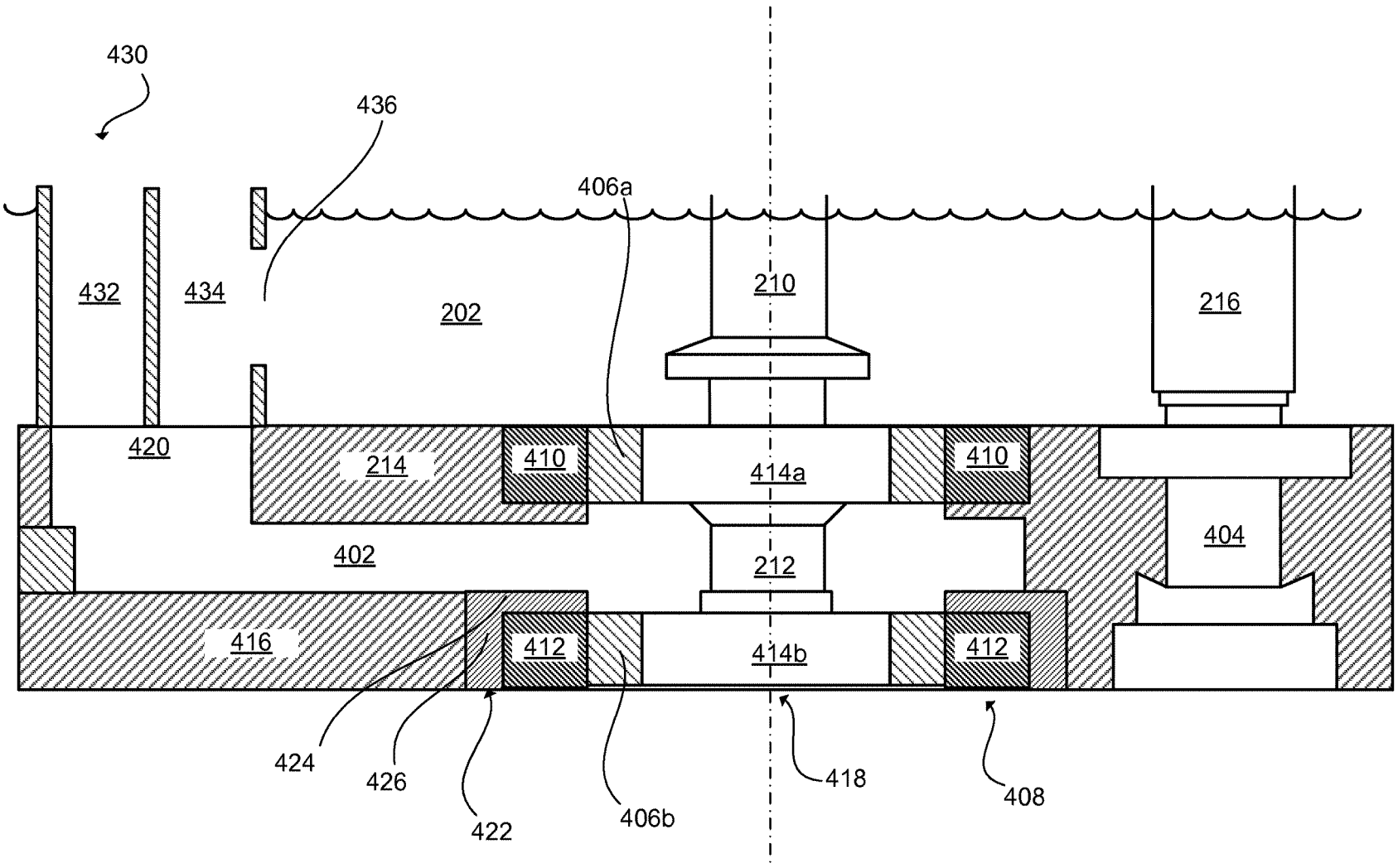
FIG. 4B illustrates a detailed cross sectional view of the base member of an another embodiment of the pump assembly of FIG. 2, the base member coupled to a riser tube which captures a portion of the molten metal that is forced out of the outlet of the chamber.

In some embodiments, it is also contemplated that at least one leakage path may also be provided downstream of the impeller 212 within the chamber 402. The leakage path may be located in any suitable position, such as in the riser 220 of FIG. 2, adjacent the outlet 420 of the base member 214, or any other suitable position in the base that is downstream of the impeller 212. In these scenarios, the leakage path may be comprised of a hole(s) drilled into the structure of the pump assembly 200. In one embodiment, referring now to FIG. 4B, the base member 214 of the pump assembly 200 of FIG. 2 is shown to include a riser 430 of a modified design. As illustrated in FIG. 4B, the modified riser 430 is coupled to the outlet 420 of the base member 214 and comprises a delivery channel 432 to deliver a portion of the molten metal 202 to a mold. The modified riser 430 further comprises a recirculation channel 434 adjacent the delivery channel 432 to direct the flow of a remaining portion of the molten metal 202 back to the bath of molten metal 202 into the holding furnace via an outlet 436 leading to an environment outside of the base member 214.

Figure 5:
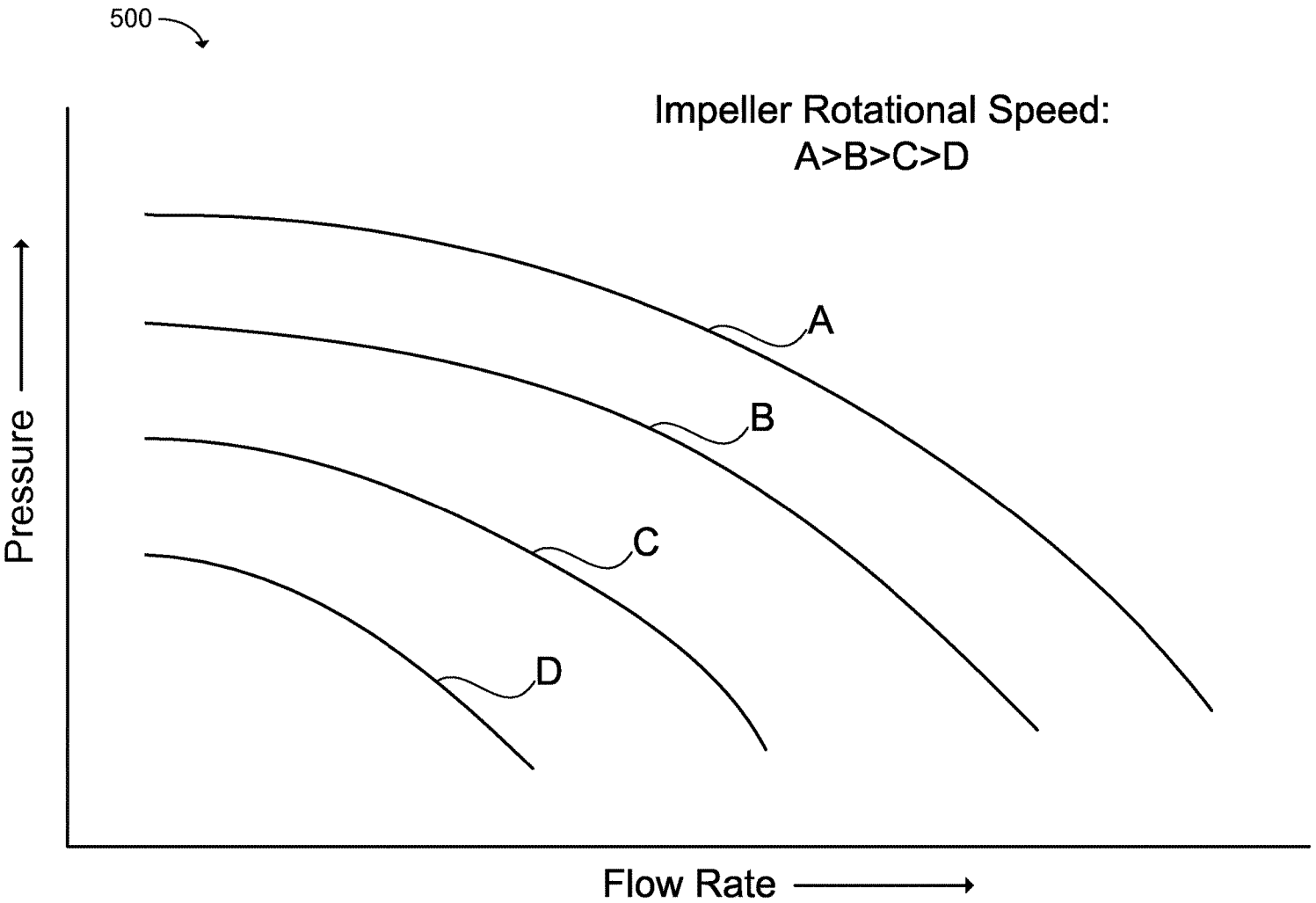
FIG. 5 is a graph showing a relationship between molten metal pressure at an outlet and molten metal flow rate for various rotational speeds of the impeller of the pump assembly of FIG. 2.

Referring now to FIG. 5, a graph showing the relationship between molten metal pressure at an outlet (i.e., head pressure) and molten metal flow rate for various rotational speeds of the impeller 212 of the pump assembly 200 of FIG. 2, or the pump assemblies 328(1)-(M) of FIG. 3, is illustrated. In some embodiments, operation of the pump assembly 200 includes an ability to statically position the molten metal 202 pumped through the outlet 420 at approximately 1.5 feet of head pressure above a surface of the bath of molten metal 202. This head pressure, in some instances, may correlate to statically holding the molten metal 202 at an opening of an associated mold. In some embodiments, the impeller 212 rotates at approximately 850-1000 rotations per minute (RPM) such that the molten metal 202 is statically held at approximately 1.5 feet above the surface of the molten metal 202. In some embodiments, the throttle manipulates the volumetric flow rate and head pressure relationship of the pump assembly 200 such that an increased amount of RPM of the impeller 212 would overcome the dampening effect and allow the reduction of head pressure as the flow rate of the molten metal 202 is increased and the molten metal 202 flows toward the mold. The graph of FIG. 5 illustrates this relationship schematically.

Figure 6:
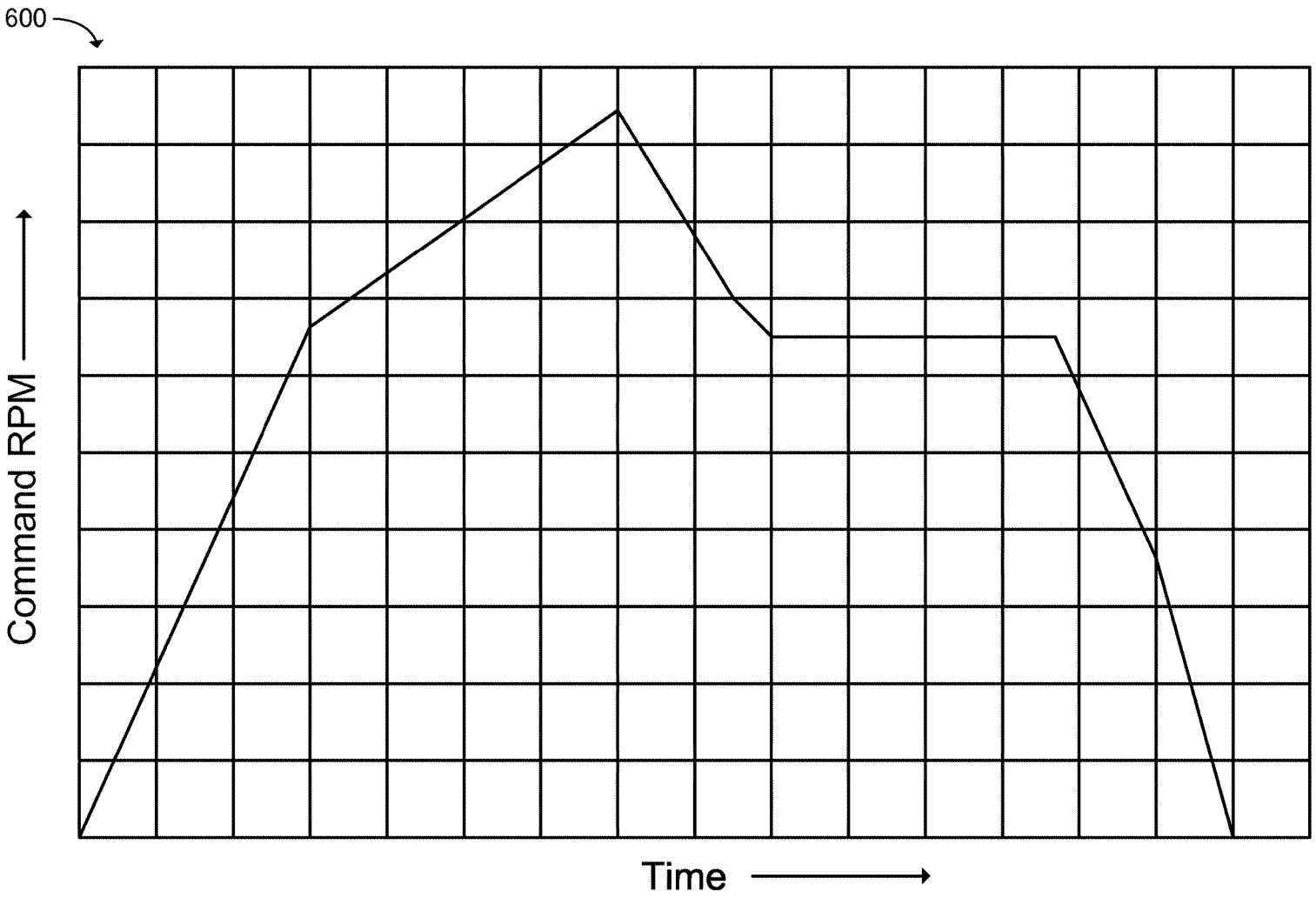
FIG. 6 is a graph showing a programmable fill profile to controllably deliver molten metal to a mold.

Referring now to FIG. 6, a command fill profile (sometimes referred to herein as a "command control profile") is illustrated by a graph showing the relationship between command RPM of the impeller 212 and time. The motor 208 of the pump assembly 200 is controlled according to a command fill profile, such as the command fill profile shown in FIG. 6, when the pump assembly 200 is used to fill a mold. A command voltage profile executed by the programmable controller operates by sending command signals electrically to the motor 208 in order to rotate the impeller 212 and force the molten metal 202 through the outlet 420 of the base member 214. The programmable fill profile shown in FIG. 6 relates to the programmable voltage profile applied to the motor 208 such that a command RPM signal for rotating the impeller 212 varies in relation to the volumetric fill rate, and sometimes the geometry, of an associated mold.

Figure 7:
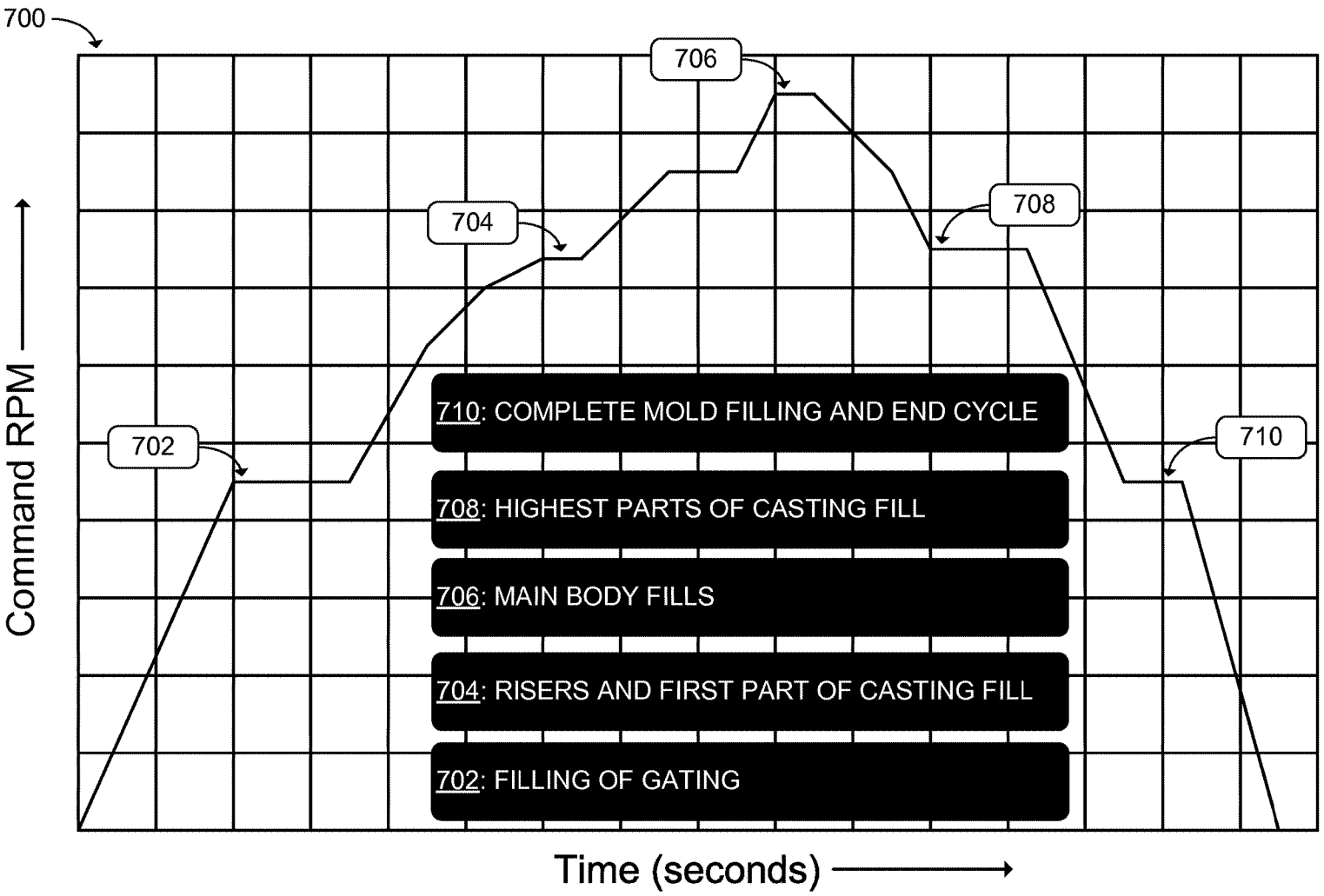
FIG. 7 is a graph of a programmable fill profile to controllably fill a complicated mold for casting molten metal.

Referring now to FIG. 7, a command fill profile for controlling the pump assembly 200 when filling a complex mold in casting applications is illustrated. In some embodiments, an associated mold, such as a mold for an engine block, may include a generally complex geometric area to be filled by the molten metal 202, such as aluminum. Such a mold may have various profiles (e.g., cylinders of an engine block) from beginning to end of the filling operation where pressure and flow rate of the molten metal 202 is appropriately controlled as the mold is filled to ensure that there is a complete fill with no casting defects (e.g., chemical defects, voids, mechanical defects, etc.). A transfer system (e.g., the transfer system 332) is configured to direct fluid to fill the associated mold with aluminum that is pumped by the pump assembly 200. A control package for the pump assembly 200 is programmed with a command fill profile, such as the one illustrated in FIG. 7. The command fill profile of FIG. 7 is associated with the inner geometric volume of the associated mold. This command fill profile relates to a command voltage at the motor 208 in order to rotate the impeller 212 at a predetermined rotational rate to fill the associated mold in accordance with form mold limits 702-710 at predetermined times. More particularly, a dampening of the magnitude of change in flow rate or pressure of the molten metal 202 relative to the rotational speed of the impeller 212 allows a reduction in the magnitude of command RPM required to provide the necessary head pressure of the molten metal 202 to the associated mold. This is advantageous when filling associated molds to form complex parts as finer tuning of an amount of the molten metal 202 provided by the pump assembly 200 is achieved.

Figure 8:
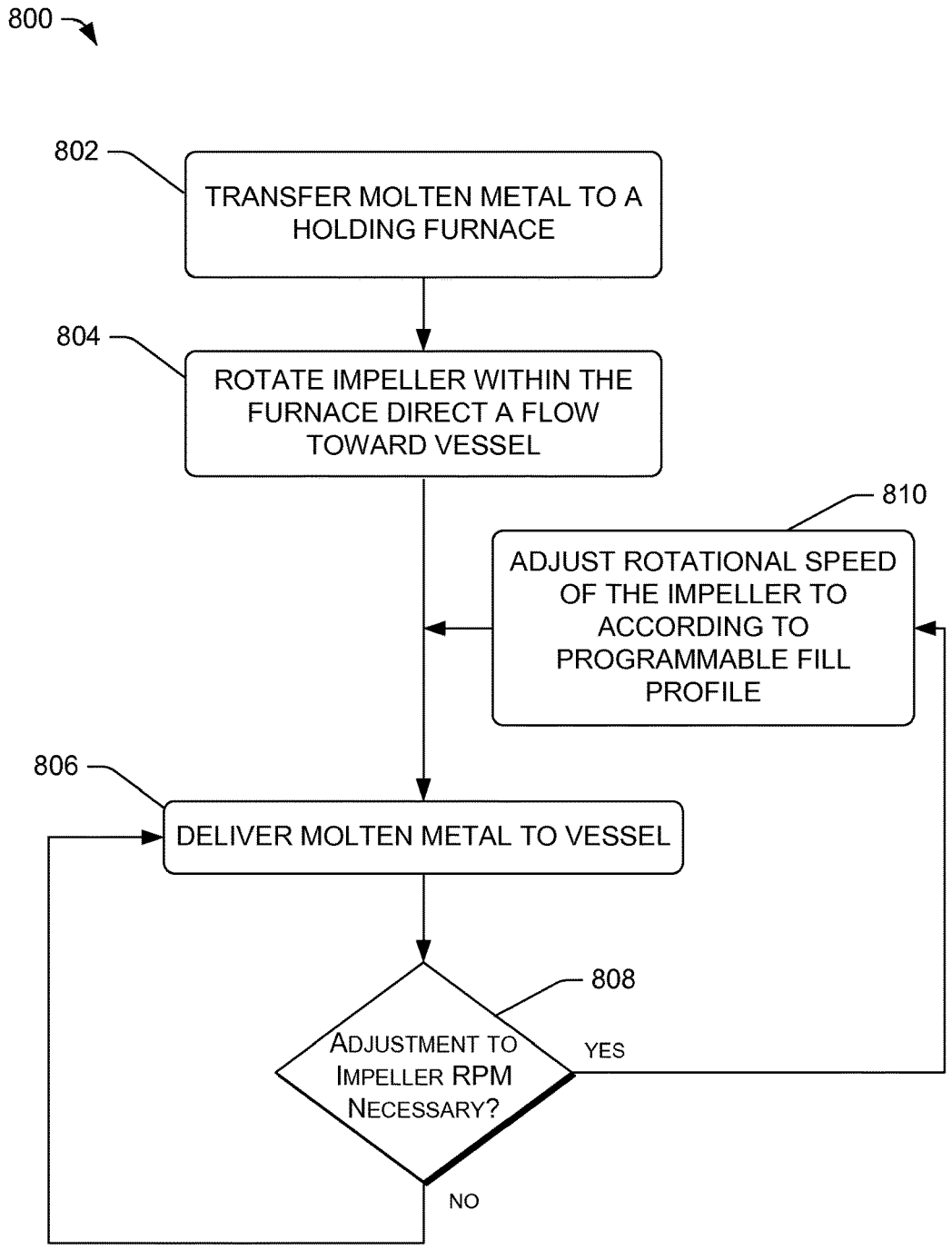
FIG. 8 is a flow diagram of an illustrative process for controlled delivery of molten metal to a mold.

FIG. 8 is a flow diagram of an illustrative process 800 for controllably filling a mold with molten metal. The process is illustrated as a collection of blocks in a logical flow graph, which represent a sequence of operations that can be implemented in hardware, software, or a combination thereof. In the context of software, the blocks represent computer-executable instructions that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order and/or in parallel to implement the process.

For discussion purposes, the process 800 is described with reference to the pump assembly 200 of FIG. 2, and also with reference to the system 300 of FIG. 3. In particular, many acts described below may be implemented and performed by the pump assembly 200, the system 300, and/or one or more associated control packages.

At 802, molten metal is transferred to a holding furnace. In some embodiments, this may be performed via a launder transfer system, such as the launder transfer system 308 of FIG. 3, between the melting furnace 302 and one or more holding furnaces 320(1)-(N).

At 804, the impeller 212 is rotated within the holding furnace to direct a flow of the molten metal toward a mold. The impeller 212 may be positioned within the chamber 402 of the base member 214 to direct, or draw, the molten metal 202 into the chamber 402.

At 806, molten metal 202 is delivered to the mold. At 808, a determination is made as to whether the rotational speed of the impeller 212 needs adjustment (i.e., increasing or decreasing the command RPM). This determination may be made according to a command fill profile, such as those described with reference to FIGS. 6 and 7, above. If it is determined that no adjustment is necessary, the process ends upon completion of the fill operation at 806. If, on the other hand, it is determined at 808 that adjustment to the rotational speed of the impeller 212 is necessary, the process may proceed to 810 where the rotational speed of the impeller 212 may be controlled/adjusted according to a command fill profile, such as the command fill profiles shown in FIGS. 6 and 7. Accordingly, the adjustment may be of a ramped nature, or a step function, depending on the particular command profile. This adjustment of the rotational speed of the impeller 212 allows for precise control of the flow rate and/or pressure of the molten metal 202 while filling a mold at 806, as shown by the looped arrow proceeding back to 806. The process ends upon completion of the fill operation at 806. Additionally, the process may be repeated from steps 806-810 such that the pump assembly 200 may be continuously running for mass production of filling molds with molten metal.

In some embodiments, the process 800 may include dampening a magnitude of a change in flow rate or pressure of the molten metal 202 relative to the rotational speed of the impeller 212. For example, a throttle may manipulate the flow rate or pressure of the molten metal relative to the rotational speed of the impeller. This may allow for fine-tuned controllability when delivering the molten metal 202 to a mold.

Currently, thousands of pressurized furnaces are used for casting, or similar applications for delivering molten metal to molds. The embodiments disclosed herein provide a revolutionary technique for controlled delivery of molten metal to molds which will transform the industry by allowing for a system that utilizes an open-furnace architecture with affordable centrifugal-type pump assemblies. This system enables high performance (e.g., up to 45-50 psi of delivery pressure) and precise control, along with mass production, and continuous operation to deliver molten metal to molds.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A system to deliver molten metal to one or more molds, the system comprising:

a holding furnace containing said molten metal, said molten metal having a bath level; and a pump assembly within the holding furnace to deliver the molten metal to at least one mold associated with the pump assembly, the pump assembly comprising:

a shaft;

an impeller coupled to the shaft and configured to direct the molten metal to the at least one mold;

a first bearing ring opposing and rotatably supporting a first radial edge at a peripheral circumference of the impeller;

a controller to control a rotational speed of the impeller according to a programmable fill profile of the at least one mold; and a throttle to enable manipulation of a flow rate or pressure of the molten metal relative to a rotational speed of the impeller, said throttle comprising a second bearing ring adjacent a second radial edge at a peripheral circumference of the impeller, wherein a radial space at a greatest extent between said second bearing ring and said second radial edge is greater than a radial space at a greatest extent between said first bearing ring and said radial edge to define a bypass gap and wherein said throttle is disposed below said bath level during operation of said pump assembly.

2. The system of claim 1, further comprising heating elements positioned underneath the holding furnace to heat the molten metal in the holding furnace.

3. The system of claim 1, further comprising:

a melting furnace; and a second holding furnace, wherein the holding furnace and the second holding furnace are each of an open configuration and configured to receive the molten metal from the melting furnace to allow for uninterrupted flow of the molten metal from the melting furnace.

4. The system of claim 3, further comprising:

a transfer pump configured to receive the molten metal from the melting furnace; and a launder transfer system coupled to the holding furnace and the second holding furnace and configured to receive the molten metal from the transfer pump and deliver the molten metal to each holding furnace.

5. The system of claim 1, wherein the holding furnace includes a degasser configured to precipitate constituents from the molten metal.

6. The system of claim 1, wherein the holding furnace includes a filter to filter constituents from the molten metal.

7. The system of claim 1, further comprising a heated transfer system configured to transfer the molten metal from the holding furnace to the at least one mold.

8. The system of claim 1, wherein the controlling the rotational speed of the impeller is based at least in part on signals from sensors within the at least one mold, the sensors being configured to monitor a status of the delivery of the molten metal to the at least one mold.

9. The system of claim 1, wherein the programmable fill profile is associated with a geometry of the at least one mold.

10. The system of claim 1, wherein the at least one mold comprises an engine block having a complex geometry.

11. The system of claim 1 further comprising more than one pump assembly.

12. A pump assembly to deliver molten metal to a mold, the pump assembly comprising:

a shaft;

an impeller coupled to the shaft and rotatably supported by a first bearing ring adjacent a first radial edge at a peripheral circumference of the impeller, said impeller configured to direct the molten metal toward the mold;

a bypass gap disposed in the pump assembly and configured to leak a predetermined portion of the molten metal to an environment outside of the pump assembly, said bypass gap comprising a second bearing ring adjacent a second radial edge at a peripheral circumference of the impeller, wherein a radial space at a greatest extent between said second bearing ring and said second radial edge is greater than a radial space at a greatest extent between said first bearing ring and said radial edge to define a bypass gap; and a controller to control a rotational speed of the impeller according to a programmable fill profile while delivering the molten metal to the mold.

13. The pump assembly of claim 12, wherein the programmable fill profile is associated with the mold.

14. The pump assembly of claim 12, wherein the pump assembly is configured to be positioned within a furnace.

15. The pump assembly of claim 14, further comprising a riser to transfer the molten metal directed from the impeller to the mold, and wherein the pump assembly is configured to statically position the molten metal within the riser above a surface of the molten metal within the furnace.

16. The pump assembly of claim 12, further comprising:

a base member providing a chamber for housing the impeller within the chamber; and a bypass gap positioned between the chamber and the impeller.

17. The pump assembly of claim 16, wherein the base member and the impeller are comprised of one of graphite or ceramic.

18. The pump assembly of claim 12, wherein the molten metal comprises molten aluminum.

* * * * *